United States Patent [19]

Reinke et al.

[11] 3,987,238

[45] Oct. 19, 1976

[54] ELECTRIC CONDUCTOR FOR THE CONDUCTION OF ELECTRIC CURRENTS OF HIGH DENSITY UNDER HEATED CONDITIONS OF THE CONDUCTING BODY

[75] Inventors: Friedhelm Reinke, Remscheid; Edgar Stengel, Wuppertal-Hahnerberg, both of Germany

[73] Assignee: AEG-Elotherm G.m.b.H., Remscheid-Hasten, Germany

[22] Filed: Nov. 20, 1974

[21] Appl. No.: 525,683

[30] Foreign Application Priority Data

Nov. 23, 1973 Germany ..... 2358391
July 2, 1974 Germany ..... 2431711

[52] U.S. Cl. ..... 174/15 C; 165/179; 174/126 R

[51] Int. Cl.[2] ..... H01B 7/34

[58] Field of Search ..... 174/15 C, 16 B, 126 R; 165/177, 179; 338/55; 336/62; 138/177; 219/10.79, 10.51, 10.49

[56] References Cited

UNITED STATES PATENTS

| | | | |
|---|---|---|---|
| 2,426,044 | 8/1947 | O'Brien | 165/177 X |
| 3,273,599 | 9/1966 | Heeren | 165/179 X |
| 3,437,132 | 4/1969 | Venema | 165/177 X |
| 3,565,118 | 2/1971 | Stearns | 174/15 S |
| 3,667,506 | 6/1972 | Jocteur | 174/102 D |
| 3,681,938 | 8/1972 | Blomberg et al. | 165/179 X |
| 3,789,129 | 1/1974 | Ditscheid | 174/102 D |

FOREIGN PATENTS OR APPLICATIONS

| | | | |
|---|---|---|---|
| 1,440,838 | 3/1969 | Germany | 174/16 B |

*Primary Examiner*—Arthur T. Grimley
*Attorney, Agent, or Firm*—Cushman, Darby & Cushman

[57] ABSTRACT

An electrical conductor of the type having a central cavity which extends along the longitudinal axis of the conductor to conduct refrigerating fluid which cools the conductor heated by high current density current flow whereby, to increase thermal efficiency and decrease deposits on the walls of the cavity which reduce the lifetime of the conductor, the cavity walls have non-smooth undulations, forming for example isosceles triangles.

3 Claims, 2 Drawing Figures

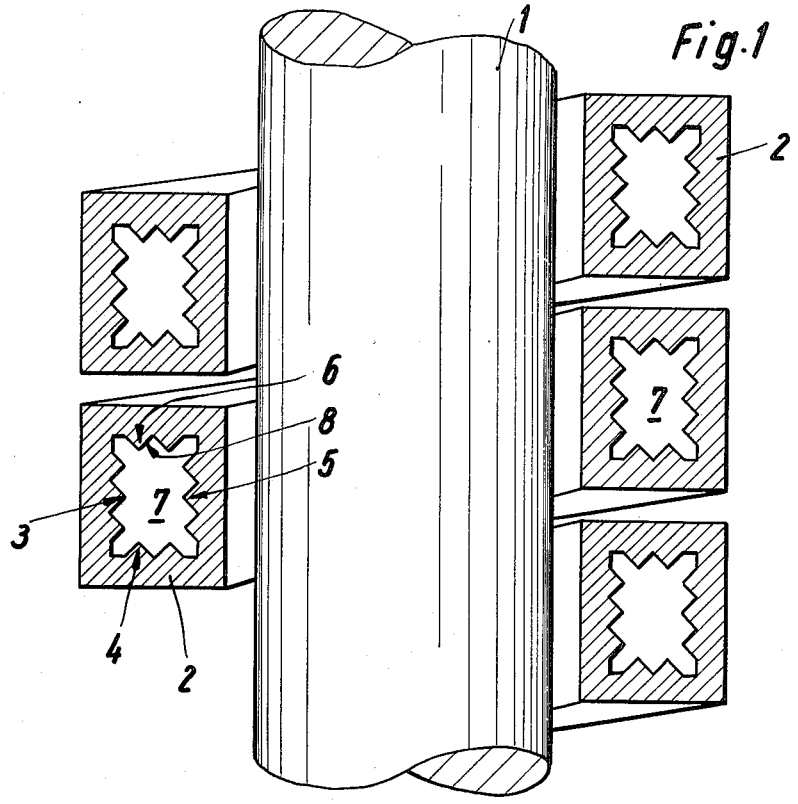
Fig.1
Fig.2
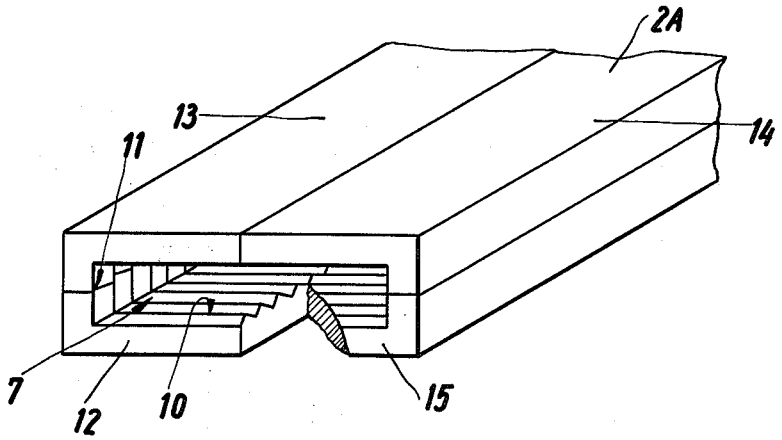

ELECTRIC CONDUCTOR FOR THE CONDUCTION OF ELECTRIC CURRENTS OF HIGH DENSITY UNDER HEATED CONDITIONS OF THE CONDUCTING BODY

BACKGROUND OF THE INVENTION

The invention relates to an electric conductor with a cavity forming a pipeline which is arranged in the conductor cross section and extends along the longitudinal axis of the conductor; this cavity holds a refrigerating agent, flowing through the conductor under pressure, and conducting electric currents of high density while the conducting body is heated.

Electric conductors of this kind are used, e.g., as inductors in high or medium frequency induction tempering installations and, generally, have in these instances a rectangular cross section with a cavity also having a rectangular cross section with smooth walls to guide the cooling water flow through the conductor. The arrangement of the conductor itself is in these cases in such shapes as will serve as inner or outer inductors, with one or several windings in the form of a fork, for instance, in the form of a flat spiral or cylindrical spiral, in flat meander form, etc.

Independently of the geometric arrangement of the conductor, it can be noticed in case of high thermal loads of such conductors that the walls of the piping for the refrigerating agent are covered, after more or less long periods of time, with deposits, of lime for instance, or other impurities of the refrigerating agent which obstruct the flow of the refrigerating agent and thus cause a further increase of the specific thermal load of the conductor.

It is, therefore, known to only use treated water for the cooling. However, under practical operational conditions the quality of the cooling water or of other liquids is not the same in all plants and does not always meet the necessary requirements. Therefore, the conductors are often destroyed after a rather short period of time.

Is is the object of this invention to increase this period of time for thermally highly loaded conductors of the above mentioned kind by decreasing the deposits on the walls of their piping for refrigerating agents.

By the same token, the problem of increasing the current density produced in the conductor without changing this period of time is solved.

In accordance with the invention, this problem, with respect to electric conductors of the kind as described above, is solved in such a way that the surface of the walls of the cavity in the conductor, which is in contact with the refrigerating agent, has a non-smooth, undulating profile showing slots, grooves, furrows, etc.

The furrows in the walls, which preferably should have the form of an isosceles triangle, can also be trapezoidal, rectangular of dovetailed or have other configurations, whereby the raised parts of the walls can either have acute-angled, obtuse-angled or rounded edges.

The furrows should preferably run in the direction of the flow of the liquid refrigerating agent.

Due to the furrowed form of the surface of the piping for the refrigerating agent, the heat contact between the refrigerated agent and the enlarged surface of the electric conductor is increased and thus the heat transfer from the conductor into the refrigerated agent is improved. The specific thermal surface load of the conductor is therefore reduced. At the same time, the speed of deposits of foreign matter in the refrigerating agent on the surface of the piping for the refrigerating agent is reduced and the operational period of time of the conductor is increased.

Deviating from the arrangements of the furrows in the direction of the flow of the refrigerating agent, the arrangement could also be such that the furrows, slots or grooves in the profile of the conductor show an inclination against the direction of the flow of the refrigerating agent or show an inclination against the direction of the refrigerating agent and in the direction of the flow. In this instance, the arrangement can be made in such a way that the furrows of the profile have little depth and small distances between each other, with a relatively great number of furrows in the walls of the electric conductor. Here it would be appropriate that the slots, grooves or rills have a distance from each other in the dimensions of millimeters and a depth which is about similar to the distance.

FIG. 1 shows the arrangement in accordance with this invention in which 1 designates part of a rear axle of an automobile, the surface of which is to be tempered by induction.

FIG. 2 is an electric copper inductor of rectangular cross section which embraces the shaft 1 spirally and receives current with a frequency of 10,000 cycles from a high frequency current source. The current density in the conductor amounts to about 1,500 amperes/square millimeter.

The design of the conductor is, at given cooling water pressure and given heat transfer figures and cooling cycle flows which can be realized, the optimum in such a way that higher losses within the given tolerances cannot be removed. In order to decrease the deposits in the piping and increase the heat transfer between piping and refrigerating agent, respectively, the four walls 3, 4, 5 and 6 of the cooling water opening 7 of the conductor 2 have a furrowed profile.

In the shown example of the design, the grooves, e.g., 8 of them, in the walls, which are directed in the direction of the flow of the refrigerating agent, are made in the form of isosceles triangles. The cooling surface of the conductor, which is facing the cooling water piping 7, is thus quite a bit enlarged and the heat transfer from the conductor body is improved.

According to the further embodiment of FIG. 2, the arrangement at the electric conductor 2 is made in such a way that the inner surface of the cavity 7 of the conductor 2A has a profile which is furrowed diagonally to the direction of the flow of the refrigerating agent flowing through the cavity 7. The furrows have again, as for the example of the design of FIG. 1, a triangular profile, as an example. In the drawing FIG. 2, the individual furrows are numbered 10 and 11, respectively.

Alternately the furrows of the profile need not be arranged vertically to the direction of the flow of the refrigerating agent flowing through the electric conduction but, for instance, inclined by 45° against this direction.

The distance of the individual furrows towards each other, for practical purposes, should be selected in such a way that a great number of furrows, for instance 10 furrows per centimeter, are installed into the profile of the electric conductor. The depth of the furrows, also for practical reasons, should in this case be limited to the dimension of the width of the furrows themselves. In order to obtain a better rinsing of the profile of the furrows, furrows with sharp edges can be avoided in favor of furrowed surfaces which are beveled.

The manufacture of corresponding conductors — as shown in FIG. 2 in the form of a diagram — can be handled in such a way that the entire conductor body is made of several partial bodies, e.g., 12, 13, 14 and 15, whose surfaces facing each other can be given the desired profile. After completion of this operation, the individual partial bodies are welded together to form one unit.

As another alternative, it is possible to arrive at an arrangement deviating from the form of furrows in such a way that the structure of the surface of the inner walls of the conductor, which are in touch with the refrigerating agent, are provided with grooves and/or rills whose longitudinal direction will be inclined against the direction of the flow of the refrigerating agent or inclined and in the direction of the flow of the refrigerating agent.

Practical tests have shown that, when using an electric conductor with furrowed, rilled or grooved profile in accordance with this invention, with a number of furrows, rills or grooves at a distance in the order of dimensions of millimeters and a depth which roughly corresponds with the distance of the grooves, independent of the direction of the furrows, rills or grooves against the direction of the flow of the refrigerating agent, have shown good cooling results for the conductor.

Further the electric conductors can be cooled by a cooling liquid whose conductor body, through which current flows, has a cavity located, in essence, centrically to the longitudinal axis of the conductor and the walls of which form a piping, which can be connected into the path of the cooling liquid, and the walls of the piping have a furrowed profile, in such a way that the furrows, grooves or rills of the profile are inclined against the direction of the flow of the refrigerating agent or inclined against the direction of the flow of the refrigerating agent and in the direction of the flow.

What is claimed is:

1. In combination, an electric conductor for the inductive heating of electrically conductive objects having a cavity which is arranged centrally in the cross section of the conductor and extends along the longitudinal axis of the conductor to form a piping to receive a refrigerating agent flowing under pressure through the conductor conducting electric currents of high current density by heating the conductor body, wherein the surface of the walls of the cavity which is in contact with the refrigerating agent, has an undulating, nonsmooth profile with undulations which extend in a direction which is inclined against the direction of flow of the refrigerating agent, means connected to said inductor for supplying current thereto and means coupled to said piping for supplying said refrigerating agent.

2. In combination as in claim 1, wherein said undulations have a distance in the dimensional order of millimeters and a depth which is about the same as the distance between the undulation.

3. In combination as in claim 1, wherein said profile is an isoceles triangle.

* * * * *